United States Patent [19]

Serber

[11] Patent Number: 4,832,407

[45] Date of Patent: May 23, 1989

[54] VARIABLE POSTURE CHAIR AND METHOD

[76] Inventor: Hector Serber, 200 Gate 5 Rd., Ste. 211, Sausalito, Calif. 94965

[21] Appl. No.: 126,035

[22] Filed: Nov. 27, 1987

[51] Int. Cl.[4] ..... A47C 7/50

[52] U.S. Cl. ..... 297/437; 297/306; 297/313; 297/429

[58] Field of Search ..... 297/353, 300, 306, 313, 297/344, 345, 429, 437, 383

[56] References Cited

U.S. PATENT DOCUMENTS

| | | | |
|---|---|---|---|
| 454,100 | 6/1891 | Wilson . | |
| 483,265 | 9/1892 | Schindler | 297/313 |
| 2,364,050 | 12/1944 | Benson . | |
| 2,400,630 | 5/1946 | Cramer et al. | 297/383 X |
| 2,439,869 | 4/1948 | Sharp | 297/437 X |
| 2,568,988 | 9/1951 | Childs | 297/353 X |
| 3,037,570 | 6/1962 | Olson . | |
| 3,165,314 | 1/1965 | Clearman et al. . | |
| 3,541,313 | 11/1970 | Buzzi . | |
| 3,669,493 | 6/1972 | Vowles . | |
| 3,754,787 | 8/1973 | Garber . | |
| 3,759,511 | 9/1973 | Zinkin et al. . | |
| 3,820,844 | 6/1974 | Fortnam | 297/437 X |
| 3,863,978 | 2/1975 | Gillings, Jr. . | |
| 4,328,991 | 5/1982 | Mengshoel et al. . | |
| 4,589,697 | 5/1986 | Bauer et al. | 297/300 |
| 4,589,699 | 5/1986 | Dungan | 297/313 X |
| 4,607,882 | 8/1986 | Opsvik . | |
| 4,614,378 | 9/1986 | Picou | 297/429 X |
| 4,641,886 | 2/1987 | Dauphin | 297/300 |
| 4,650,249 | 3/1987 | Serber . | |
| 4,662,681 | 5/1987 | Favaretto | 297/353 X |

FOREIGN PATENT DOCUMENTS

| | | | |
|---|---|---|---|
| 2558669 | 7/1977 | Fed. Rep. of Germany | 297/429 |
| 2837558 | 3/1980 | Fed. Rep. of Germany | 297/345 |
| 1309905 | 10/1962 | France | 297/353 |

*Primary Examiner*—Peter A. Aschenbrenner
*Assistant Examiner*—Thomas A. Rendos
*Attorney, Agent, or Firm*—Flehr, Hohbach, Test, Albritton & Herbert

[57] ABSTRACT

A variable posture chair (1) including a horizontally oriented seat (2), a vertically oriented body support platform (2) and an upwardly inclined leg support platform (4) is disclosed. At least one of the body support platform (2) and leg support platform (4), and preferably both, are movably mounted with respect to the seat (3) to enable support of the user in any one of six support posture modes. Both the body support and leg support platforms (2,4) are pivotally mounted about a central post assembly (10) for the seat (3). A method of supporting a user on the posture chair (1) is also disclosed.

19 Claims, 6 Drawing Sheets

VARIABLE POSTURE CHAIR AND METHOD

TECHNICAL FIELD

The present invention relates, in general, to an ergonomic chair built for distributing the weight of a user while seated in a variety of postures on the chair, and more particularly, relates to an ergonomic chair or seating assembly in which the various components of the chair can be adjusted and rearranged geometrically to allow the user to fit the chair to his body.

BACKGROUND ART

I have previously developed an ergonomic seating assembly in which three platforms or support surfaces can be used to provide a highly comfortable and efficient support system for a user while seated. This seating assembly is set forth in my U.S. Pat. No. 4,650,249 and includes a seat, a body support platform, and a let support platform. All three elements were movable to varying degrees to attempt to enable the user of the ergonomic chair to efficiently support his or her body weight in a number of different postures.

In addition to the chair of my patent, various other chair or seat assemblies have been devices which support the user's torso and/or legs. Thus, in U.S. Pat. Nos. 3,165,314, 3,754,787 and 3,759,511 chair assemblies are shown in which body or torso support platforms are provided with varying degrees of adjustment. In U.S. Pat. Nos. 454,100, 2,364,050 and 4,507,882 chair assemblies are shown in which the back of the chair can also be used as a torso support platform if the user turns around and sits facing what would nominally be regarded as the chair back. Finally, in U.S. Pat. Nos. 3,037,570, 3,541,313, 3,669,493, 3,863,978 and 4,328,991 various seat assemblies are shown which include a shin or leg support structure.

While these prior art chair assemblies have various advantageous and disadvantages, they tend to be designed for a particular purpose and user posture. Even the chairs which contemplate that the user may sit in both a forward and a rearward facing direction, tend to be very limited in the manner in which a person's weight can be supported on the chair.

Accordingly, it is an object of the present invention to provide a chair assembly and method of seating using three weight supporting platforms which can be moved or arranged geometrically to enable the user to be seated and supported in a variety of different postures.

It is a further object of the present invention to provide a chair assembly which is capable of supporting the body of the user so that the musculature can be relaxed in any one of a plurality of seating postures.

Another object of the present invention is to provide a chair assembly and method in which the weight of the body of the user can be more evenly distributed and supported over the chair assembly.

Another object of the present invention is to provide a chair assembly which can be easily adjusted and changed to accommodate changes in the posture of the user while seated on the chair.

Still further an object of the present invention is to provide a chair assembly having a leg support platform in which the leg support platform can be selectively positioned for support of the user's legs when facing in forward or a rearward direction or can be stored to permit the user to support his legs on the floor.

Another object of the present invention is to provide a seat assembly and leg support therefor which enables seating in a kneeling posture at virtually any orientation around the seat assembly.

Another object of the present invention is to provide a variable posture chair which is durable, easy to adjust, requires minimum maintenance and is compact.

The variable posture chair method of the present invention have other objects and features of advantage which are set forth in more detail and will be apparent from the following description of the Best Mode Of Carrying Out The Invention and the accompanying drawings.

DISCLOSURE OF THE INVENTION

The variable posture chair of the present invention includes a seat supported in a generally horizontal orientation, a body or torso support platform mounted proximate and above the seat, and a leg support platform mounted proximate and below the seat. The improvement in the posture chair comprises, briefly, the body support platform being mounted in a near vertical orientation; and the leg support platform being mounted in an upwardly inclined plane intersecting the plane of the seat for support of the shins of the person when the person's chest is supported on the body support platform and for support of at least one leg of the person when the person's back is supported on the body support platform. Preferably at least one of the body support platform and the leg support platform is movable, and most preferably, the leg support platform is mounted for selective movement between a deployed position and a stored position. Each of the body support platform and leg support platform may be pivotally mounted so that they can rotate in a full circle about a center post supporting the seat to allow different geometric combinations with the seat to accommodate various postures of the user.

BEST MODE FOR CARRYING OUT THE INVENTION

Figure 1:
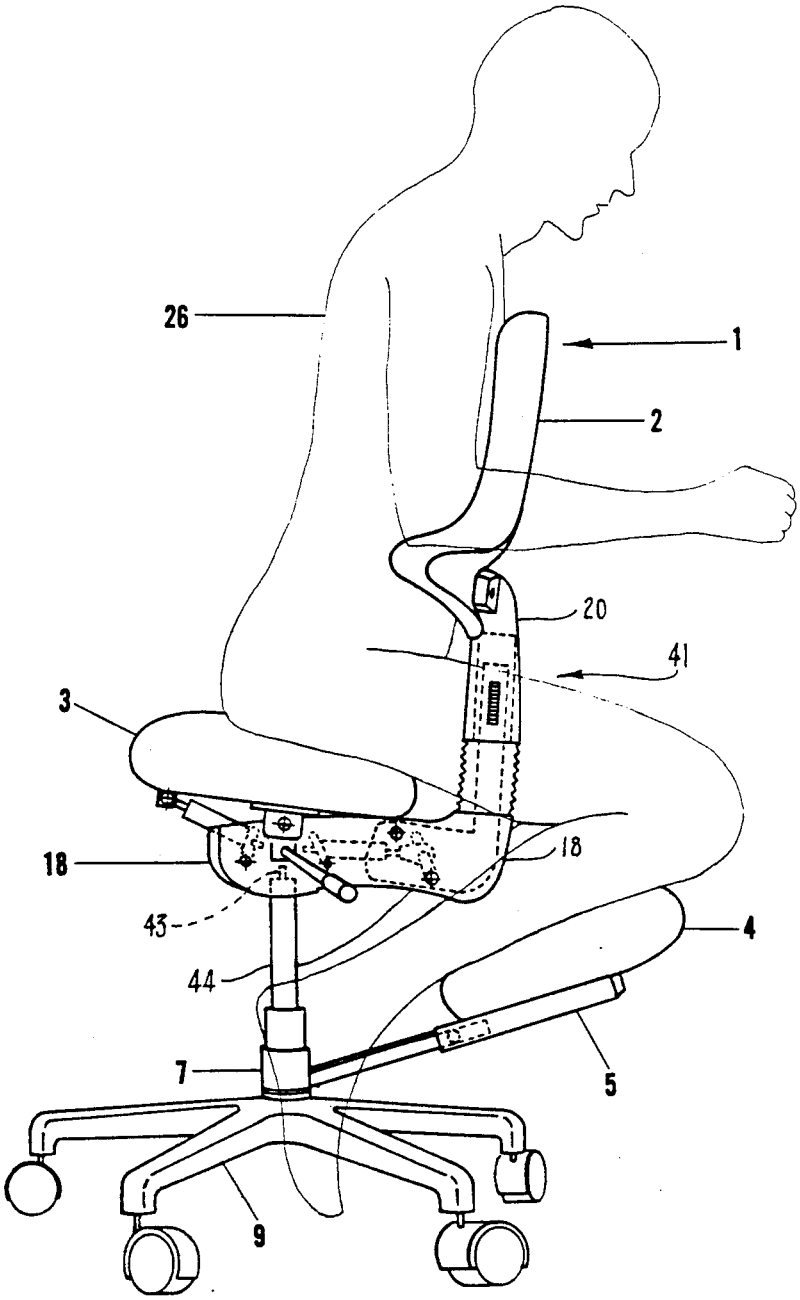
FIG. 1 is a side elevation view of a variable posture chair constructed in accordance with the present invention with the person seated in a forward tilted mode with his shins supported on the leg support platform.
Figure 2:
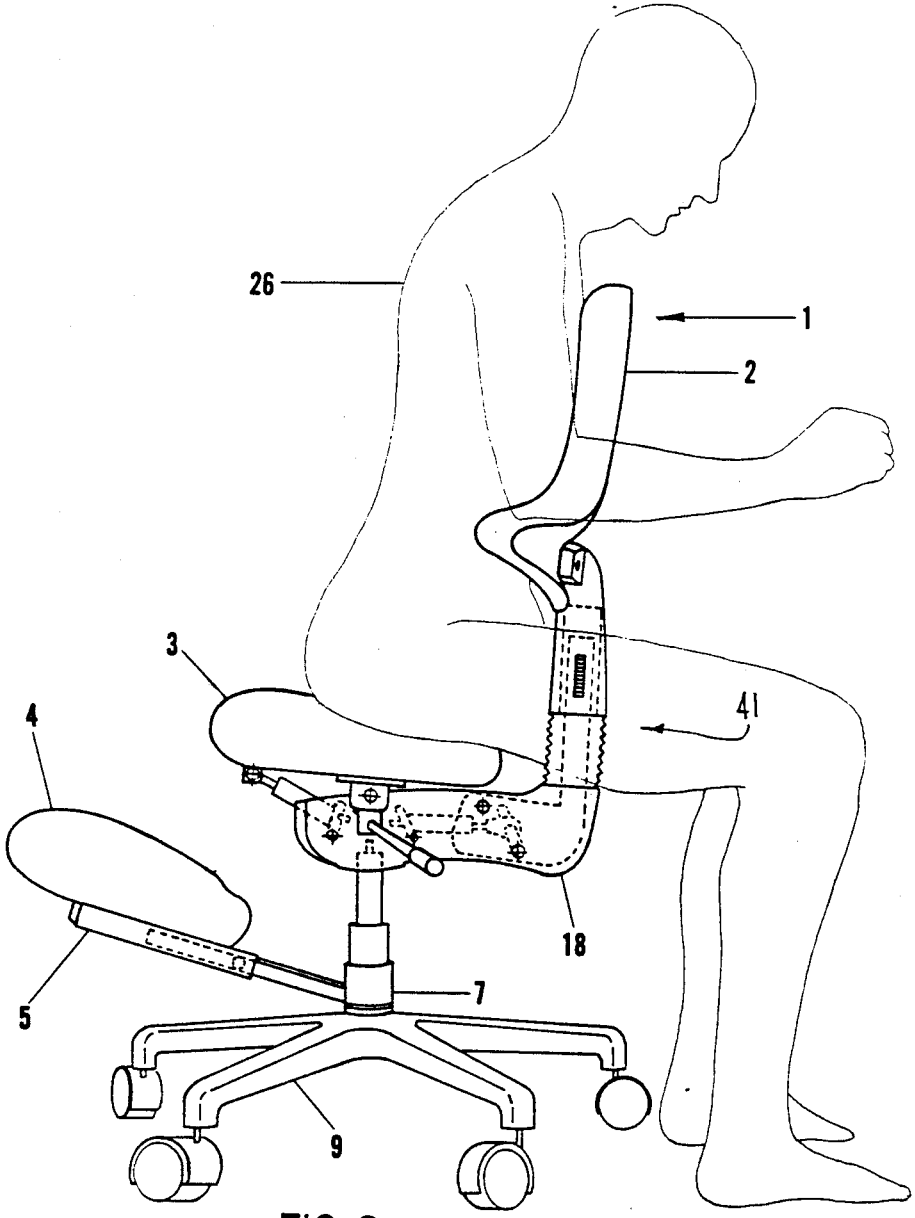
FIG. 2 is a side elevation view corresponding to FIG. 1 with the leg support platform rotated by 180 degrees and a person seated in a forward tilted mode with his feet supported on the floor.

The posture chair of the present invention, generally designated 1, includes seat 3 which is supported in a generally horizontal orientation. Mounted in a near vertical orientation proximate seat 3 is a body or torso support platform 2. Body support platform 2 is positioned sufficiently above seat 3 to enable the user 26 of the chair to position his legs between platform 2 and seat 3. This enables the user to sit, as shown in FIGS. 1 and 2, with his legs on either side of the L-shaped arm assembly 41 to which body support platform 2 is mounted. Moreover, the user may reverse himself on the seat and use the body support platform 2 as a back support, as shown in FIGS. 3 and 4.

In order to provide additional support for the user, the variable posture chair of the present invention further includes a leg support platform 4 mounted proximate and below seat 3 and, in the preferred form, in a plane sloping upwardly and intersecting with the plane of seat 3 for support of the user's shins while the user's chest in supported in a near vertical orientation by platform 2.

Figure 3:
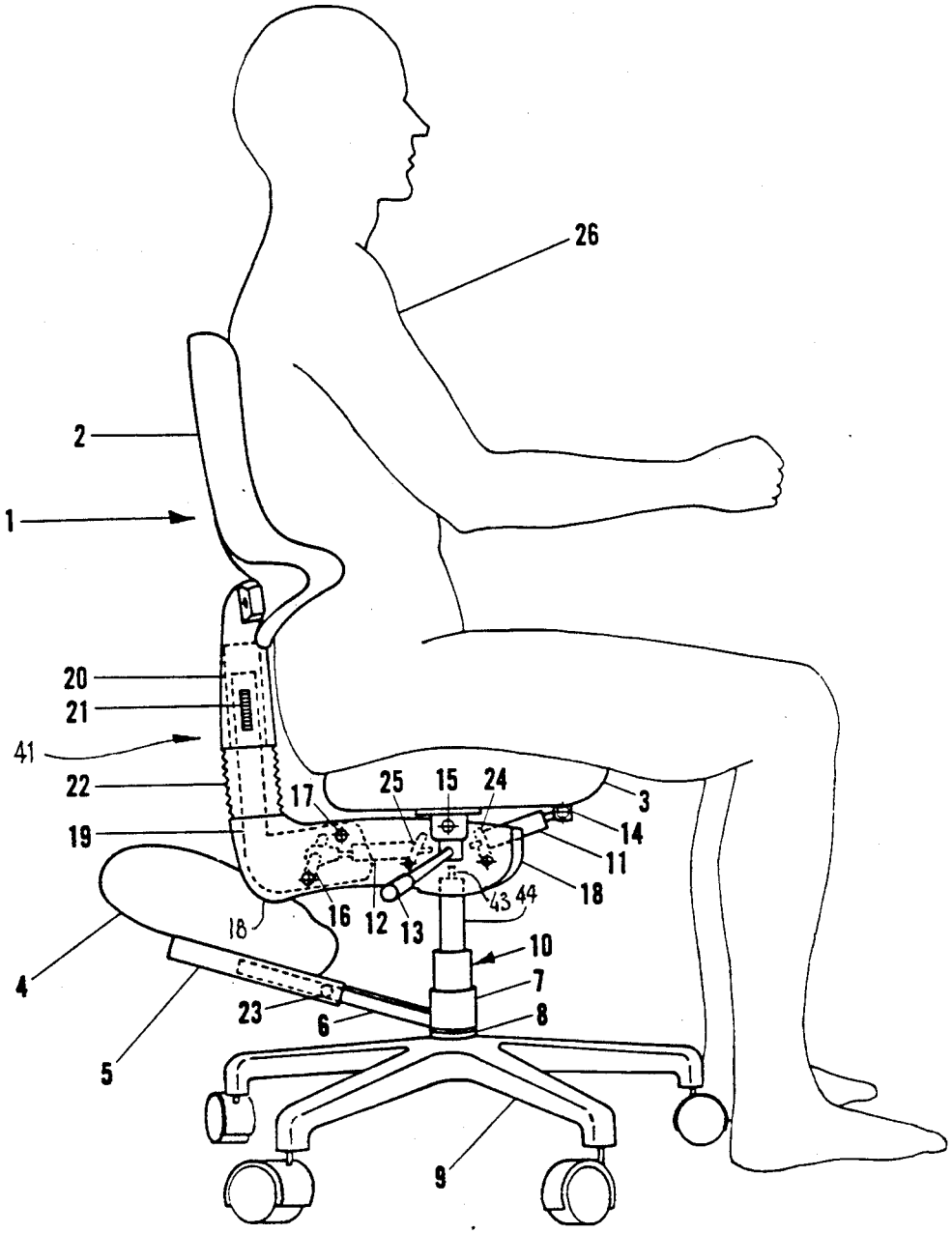
FIG. 3 is a side elevation view coresponding to FIG. 1 with the user reversed from FIG. 1 and in a conventional seated mode.
Figure 4:
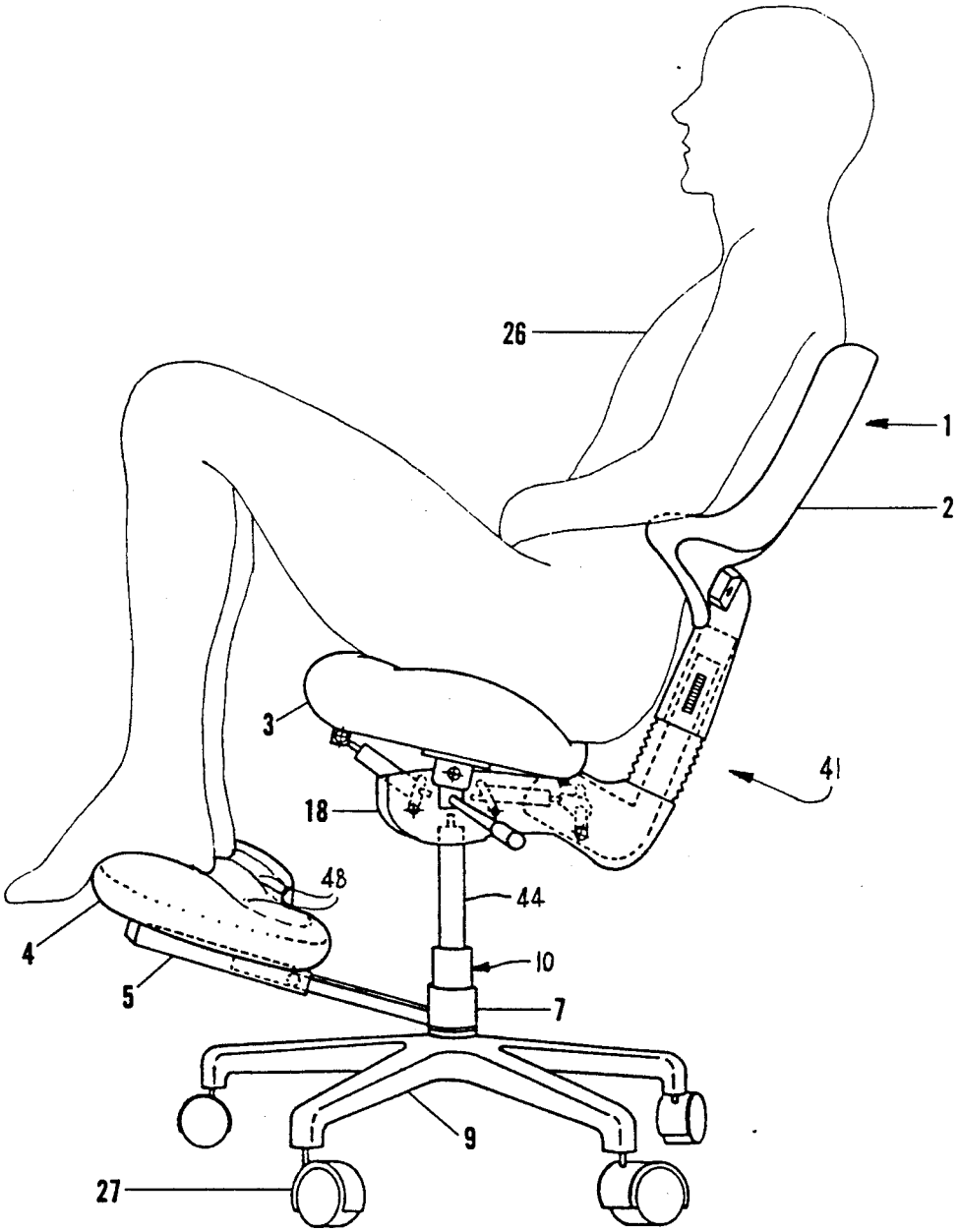
FIG. 4 is a side elevation view corresponding to FIG. 2 with the person reversed and sitting in a rearwardly reclined mode with feet supported on the leg support platform.

As thus far described, therefore, the chair of the present invention can be selectively used in a forwardly tilted mode as shown in FIG. 1 to provide support of the user's entire body weight in a comfortable and relaxed position, or as a conventional chair in a seated mode, as shown in FIG. 3. The user need only stand up or raise off seat 3 and reverse his position from FIG. 1 to that of FIG. 3, or vice versa. While it is an important feature of the present invention to provide a posture chair in which one or both of the body support and leg support platforms are movable, in its broadest aspect, neither the body support platform nor leg support platform need be movable in order to use the chair as shown in FIGS. 1 and 3.

Enhanced versatility is achieved in the posture chair of the present invention by providing an assembly in which at least one of body support platform 2 and leg support platform 4 are movably mounted relative to seat 3. In the form of the invention shown in FIGS. 1 through 5, the leg support platform 4 is mounted for pivotal movement about central post assembly 10, while in the form of the chair in FIG. 6, both the body and leg support platforms are movable about central post assembly 10.

Movably mounting platform 4 to post assembly 10 significantly increases the versatility of the posture chair of the present invention. Platform 4 preferably is mounted to a member 5 that is telescoped on the end of radially and upwardly extending arm 6. A locking screw 23 can be used to enable adjustment and locking of the telescoped members 5 and 6 in a position which is most comfortable for the particular user employing the chair. Arm 6 is fixedly mounted to a collar or sleeve 7 that is pivotally mounted about post 10 and supported on a spacer or bearing washer 8. Post assembly 10, in turn, is mounted to base 9, which advantageously may include casters 27 for rolling support of the chair on a floor or similar support surface. The collar 7 permits the user to rotate platform 4 about the central longitudinal axis of post assembly 10 between the position of FIG. 1, a deployed position, and the position of FIG. 2, a stored position.

The expressions "deployed position" and "stored position" are used to indicate whether or not the leg support platform is positioned for support of the weight of the user's legs. In FIGS. 1 and 2, for example, the user's chest is being supported by platform 2, while the leg support platform is deployed in FIG. 1 and stored in FIG. 2. By contrast, in FIGS. 3 and 4, the user's back is supported by platform 2, while the leg support platform is deployed in FIG. 4 and stored in FIG. 3. The ability to move the leg support platform relative to seat 3 enables the user to select to either deploy or store the leg support platform in either a tilted forward mode or a conventional seated (rearwardly inclined) mode.

Figure 5:
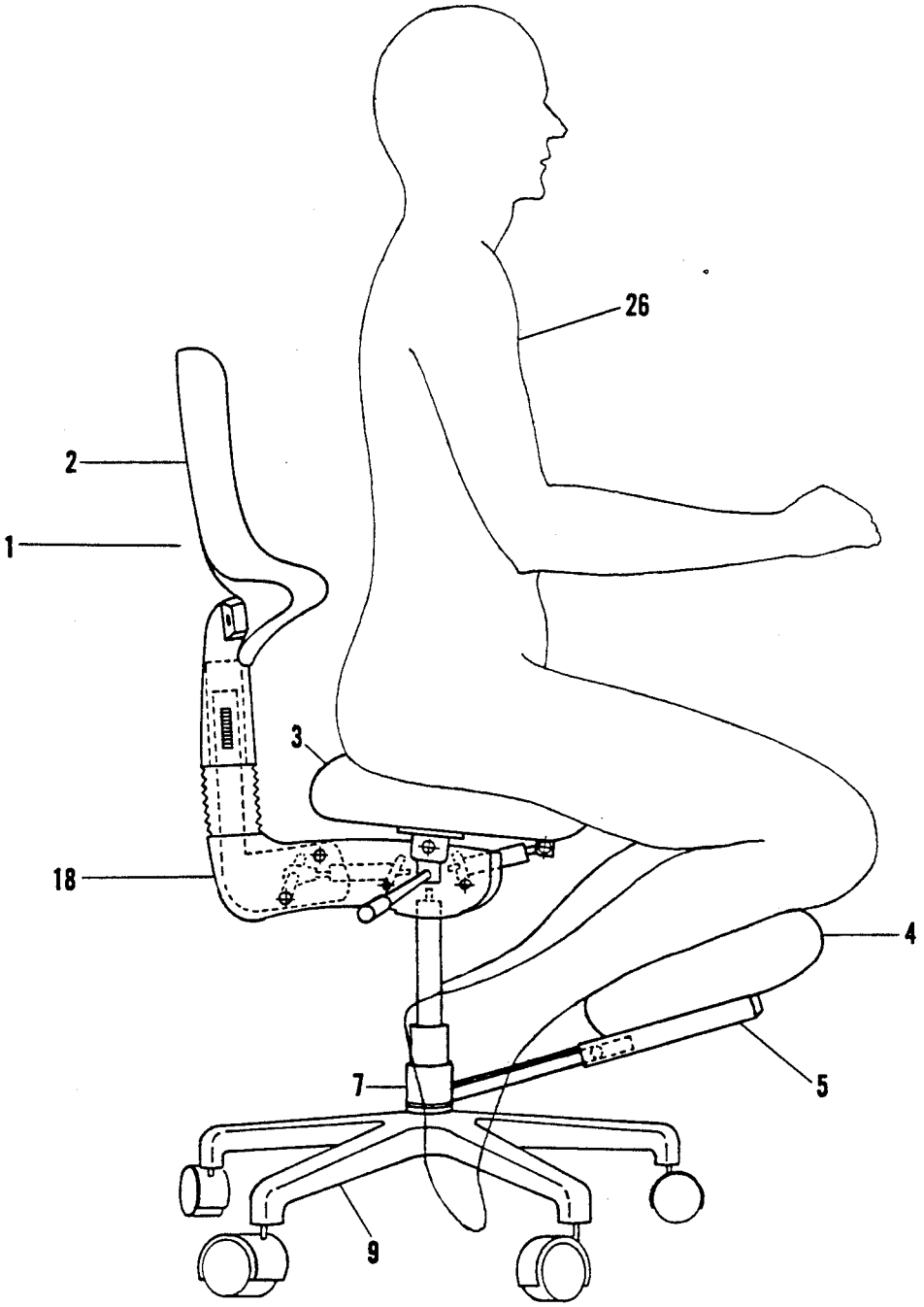
FIG. 5 is a side elevation view corresponding to FIG. 3 with the leg support platform rotated by 180 degrees and a person sitting in a kneeling mode.

In addition to the four seating modes in FIGS. 1 through 4 which result from having one of the body support platform and leg support platform movable, in this case the leg support platform, the chair of the present invention also can be used in a kneeling mode or the posture shown in FIG. 5. In this posture, the body support platform 2 does not function to support body weight, but it is available to the user without obstructing the user's use of the chair as a kneeling stool.

Figure 6:
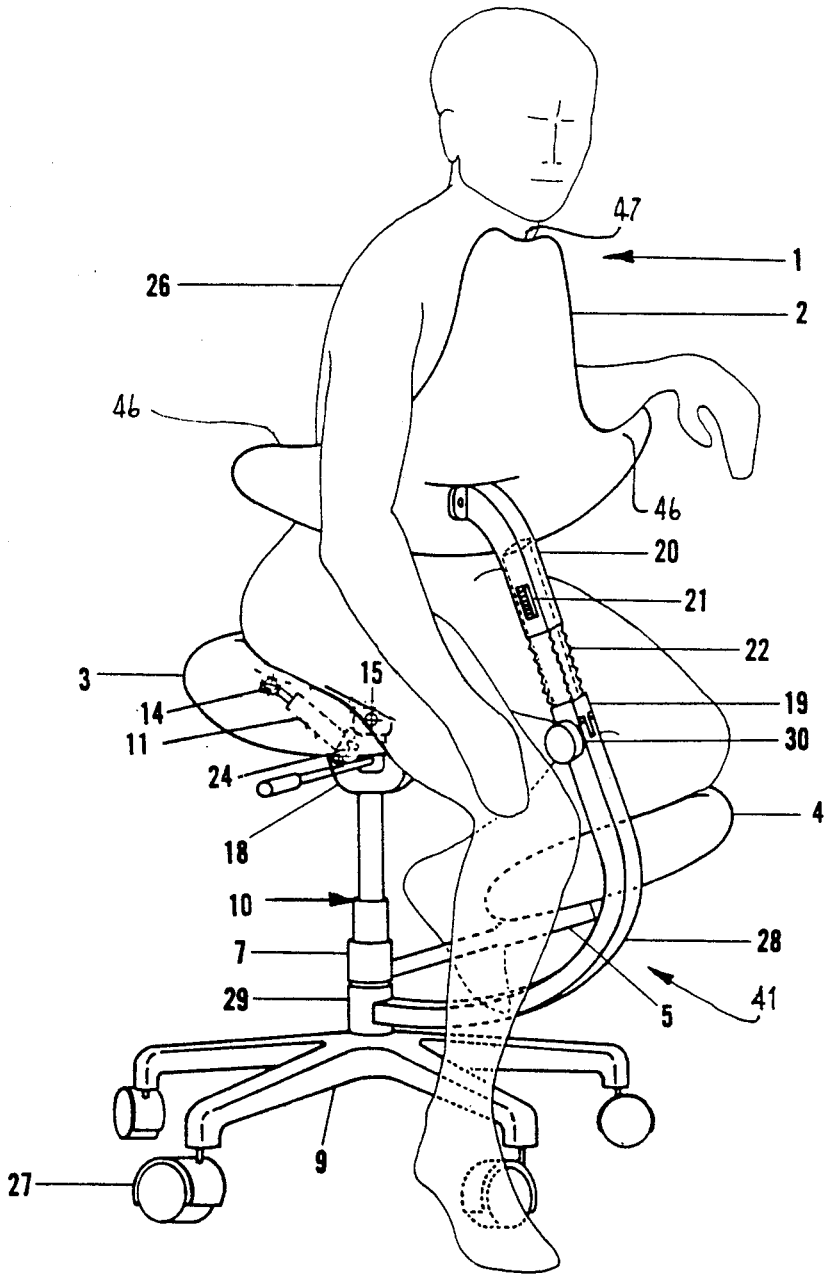
FIG. 6 is a side elevation view corresponding to FIG. 1 with the body support platform rotated slightly in one direction and the leg support platform rotated in an opposite direction to support the user in a forward tilted mode with one foot on the floor.

In the form of the invention shown in FIGURE 6 a sixth posture mode is shown in which the ability to pivot both platform 4 and platform 2 about central post assembly 10 allows the user to move the two platforms to a position at which they are at a slight angle to each other. This allows one leg to be supported on platform 4, while the other leg is supported on the floor and the user's chest is supported on platform 2. Moreover, the user can pass his legs between seat 3 and support means 28 for the torso support platform 2. This allows platform 2 to be rotated between chest and back supporting positions without requiring the user to leave seat 3.

The details of construction of the two L-shaped mounting assemblies for body support platform 2 can now be described. In the form of the invention shown in FIGS. 1 through 5, body support platform 2 is mounted to an upper vertically oriented arm member 20 having a socket which receives a steel post or channel 19 in telescope relation thereto. The two telescoped parts can be selectively adjusted and locked in position by latch means 21, and it is preferable that an accordion boot 22 extend between the upper member 20 and arm lower members or housing 18. The chair seat is pivotally mounted to housing 18 by pivot pin 15, which permits tilting in a forward and a rearward direction to a limited degree. It is preferable that such tilting be limited to about 15 degrees in a forward direction and about 15 degrees in a rearward direction from a horizontal plane. Such tilting will allow the seat to be tilted slightly toward platform 2 when it is used as a chest support platform (FIGS. 1 and 2) or tilted away from platform 2 when it is used as a kneeling stool (FIG. 5).

In the most preferred form, a hydraulic cylinder or lift assembly 11 is pivoted between pins 14 and 24 to enable adjustment and control of the degree of tilting of seat 3 with respect to housing 18.

In a similar manner, the body support platform 2 preferably is adjustably tiltable from a vertical position. Thus, L-shaped post or channel 19 is pinned for relative rotation to housing 18 through pivot pin 17. A second hydraulic cylinder lift 12 is pivotally attached to channel 19 through pin 16 and to housing 18 by pivot pin 25. Extension and contraction of lift 12, therefore, will cause pivoting of the steel post member 19 with respect to housing 18 to enable adjustment of the body support platform. In the preferred form, the body support platform can be positioned between vertical and a rearwardly tilted plane of not more than about 35 degrees.

Finally, the post 10 most preferably is provided by a lift or hydraulic cylinder assembly that can be used to raise and lower seat 3. Such hydraulic lifts or cylinders 10, 11 and 12 are well known in the chair art and the details of construction of the same are not pertinent to the present invention. All three of these cylinders can be controlled from a central control lever 13. Manipulation of the control level 13 by angular displacement of the same in various directions can release and thereafter lock various ones of the lifts 10, 11 and 12 to permit the desired adjustment.

It is also possible to pivot housing 18 about the upper end 43 of post assembly member 44. This allows the seat and body support platform to be pivoted as a unit with respect to the base and leg support platform or the leg support platform to be pivoted on collar 7 without movement of the seat and body support platform.

In the form of the invention shown in FIGURE 6, the support platform 2 is mounted to an L-shaped arm assembly 41 which is fixed to a collar or sleeve 29 pivotally mounted to center post assembly 10 below the collar 7 for the leg support platform. The FIG. 6 body support platform mount assembly 41 includes a curved arm portion 28 secured to collar 29 and having the post 19 pivotally mounted to an upper end thereof. The angular orientation of post 19 with respect to member 28 can be adjusted and locked in position by locking screw 30. The assembly above the angular adjustment locking knob 30 is as described for the chair FIGS. 1 through 5.

As may be seen best in FIG. 6, it is preferable that the body support platform include laterally extending arm support portions 46 and a chin support portion 47. The arm support surfaces or portions 46 enable the weight of the user's arm to be selectively supported, and the chin support portion 47 allows the user to rest his muscles, particularly in the forward leaning or tilting mode.

It is further preferable that body support platform 2, seat 3 and leg support platform 4 be molded to conform to the respective body parts which are supported on the same. As best may be seen in FIG. 4, leg support platform 4 can include a pair of molded recesses or grooves 48 which are dimensioned to receive the shins of the user or the feet of the user when supported on the platform. Similarly, seat 3 can be molded to conform to the buttocks of the user, as seen in FIG. 4, and the platform 2 is preferably curved to conform to the front or back of the user's torso.

The method of supporting a person of the present invention enables a person to assume any one of six different weight support combinations while seated on the posture chair of the present invention. The method includes the steps of positioning a seat support platform 3 under the buttocks of the person, positioning a movable body support platform 2 for selected support of either of the person's chest or back at a height above the seat sufficient to enable the person's legs to be positioned between the seat and body support platform, and positioning a movable leg support platform below the seat for movement between a deployed position for selective support of the person's shins, legs or feet and a stored position enabling support of the person's feet on the floor. This method will enable the person to sit in any one of the six positions FIGS. 1 through 6.

What is claimed is:

1. A variable posture chair comprising:

(a) a seat having a periphery and supported in a generally horizontal orientation;

(b) a body support platform mounted proximate said periphery and above said seat in a near vertical orientation for support of the front of the body when of a user seated on said seat, said body support platform being positioned a sufficient distance above said seat to enable a user seated on said seat to position his legs between said seat and said body support platform; and (c) a shin support platform positioned below and proximate said periphery of said seat and positioned on a side of said seat having said body support platform, said shin support platform being upwardly inclined on a plane facing inwardly toward said seat and said shin support platform extending outwardly of said periphery of said seat by a sufficient distance for support of said user's shins thereon while the front of the user's body is supported on said body support platform.

2. A variable posture chair including a seat supported in a generally horizontal orientation, a body support platform mounted in a near vertical orientation proximate and sufficiently above said seat to enable a user to position his legs therebetween, and a leg support platform mounted proximate said seat and extending to a position sufficiently in advance of said seat for positioning of said user's shins on said leg support platform while seated on said seat, wherein the improvement in said posture chair comprises:

at least one of said body support platform and said leg support platform being movable relative to said seat to enable selective movement of at least one of said body support platform and said leg support platform between a position supporting the front of said user's body on said body support platform while supporting said user's shins on said leg support platform, and a position supporting the back of said user's body by said body support platform while supporting said user's legs by said leg support platform.

3. The posture chair as defined in claim 2 wherein, said leg support platform is mounted for selective rotational movement about a vertical axis through said seat between a deployed position relative to said seat, for support of said user's shins while seated on said seat, and a stored position rotated from said deployed position.

4. The posture chair as defined in claim 2 wherein, said body support platform is mounted for pivotable movement between said chest supporting position and said back supporting position; and said leg support platform is mounted for pivotal movement between said deployed position and said stored position.

5. The posture chair as defined in claim 4 wherein, said seat is mounted to a vertically oriented post means; and said body support platform and said leg support platform are both mounted to said post means for independent pivotal movement around said post means and around said seat.

6. The posture chair as defined in claim 2 wherein, said seat is mounted for limited angular tilting in both a forward direction and a rearward direction from a horizontal plane.

7. The posture chair as defined in claim 6 wherein, said seat is mounted for tilting from a horizontal plane in said forward direction in an amount up to about 15 degrees and for tilting from a horizontal plane in said rearward direction in an amount up to about 15 degrees.

8. The posture chair as defined in claim 2 wherein, said body support platform is tilted in a forward direction from a vertical plane in said chest support position up to about 35 degrees and is tilted in a rearward direction from a vertical plane in said back supporting position up to about 35 degrees.

9. The posture chair as defined in claim 2 wherein, said body support platform includes arm rest portion in the form of an upwardly facing surface extending laterally of and proximate to a lower end of said body support platform.

10. The seat assembly including a seat, vertically oriented post means supporting said seat in a generally horizontal orientation above a support surface, and a leg support platform mounted proximate said seat in a position supporting the legs of a user seated on said seat, wherein the improvement in said seat assembly comprises:

said leg support platform extending sufficiently in advance of said seat for supporting the shins of said user thereon while seated on said seat; and said leg support platform being mounted for pivotal movement about a vertical axis for rotation of said leg support platform circumferentially with respect to said seat.

11. The seat assembly as defined in claim 10 wherein, said leg support platform is mounted to said post means for pivotal movement;

and said seat is mounted to said post means for tilting from a horizontal plane toward said leg support platform when said leg support platform is in at least one circumferential position about said seat.

12. A method of supporting a person to enable the person to assume any one of six different weight support combinations while seated on a posture chair supported on a floor comprising the steps of:

positioning a seat support platform of said posture chair under the buttocks of the person;

positioning a movable body support platform for selected support of either of the person's chest or back at a height above said seat support platform sufficient to enable the person's legs to be positioned between the seat support platform and the body support platform when said body support platform supports the person's chest; and positioning a movable leg support platform below said seat support platform for movement between a deployed position for selective support of the person's shins, legs or feet and a stored position enabling support of the person's feet on said floor.

13. A posture chair comprising;

(a) a seat supported in a plane tilted slightly in rearward direction from a horizontal plane; and (b) a body support platform mounted on a rearward side of said seat proximate and above said seat in a near vertical orientation, said body support platform being positioned a sufficient distance above said seat to enable a user seated on said seat facing said body support platform to position the user's legs between said seat and said body support platform, and said body support platform being formed with a lower portion which extends circumferentially sufficiently around the user's body to engage and support the user's hips on both sides of the user's body when the front of the user's body is engaged by the body support platform and to support the user's mid-lumbar region when the back of the user's body is engaged by the body support platform.

14. The posture chair as defined in claim 13 wherein, an upper portion of said body support platform extends to the user's sternum, and said upper portion is relatively narrow as compared to said lower portion for unimpeded movement of the user's arms while the front of the user's body is supported on said body support platform.

15. The posture chair as defined in claim 13 wherein, said lower portion of said body support platform has a surface engaging the user which is concaved about a vertical axis to matingly engage the user's body, and said body support platform has a surface engaging the user which is concave at a mid-lane of said body support platform over the height of said body support platform with respect to a horizontal axis.

16. The posture chair as defined in claim 13 wherein, said seat is mounted for tilting toward and away from said body support platform, and said body support platform is mounted for vertical adjustment with respect to said seat.

17. The posture chair as defined in claim 16 wherein, said lower portion of said body support platform does not extend substantially below the user's hips intermediate the positions of engagement of the hips.

18. The posture chair as defined in claim 13 wherein, said body support platform has an overall height dimension extending from the user's mid-lumbar region to the user's mid-thorax region.

19. The posture chair as defined in claim 13, and a leg support platform mounted proximate and below said seat and mounted for rotation about a vertical axis through said seat, said leg support platform being positioned relative to said seat for support of the user's shins thereon where the front of the user's body is supported on said body support platform and when the back of the user's body is supported on the body support platform.

* * * * *